US005337538A

United States Patent [19]

Ljungström

[11] Patent Number: 5,337,538

[45] Date of Patent: Aug. 16, 1994

[54] GABLE-TOP CARTON BLANK FOR DIVERSE PACKAGING MACHINES AND METHODS OF MAKING AND USING THE BLANK

[75] Inventor: Tommy B. G. Ljungström, Buffalo Grove, Ill.

[73] Assignee: Tetra Laval Holdings & Finance S.A., Switzerland

[21] Appl. No.: 106,361

[22] Filed: Aug. 12, 1993

[51] Int. Cl.[5] ..... B65B 43/10; B65B 7/18; B65D 5/42

[52] U.S. Cl. ..... 53/456; 53/458; 53/491; 229/137; 229/138; 206/217; 493/165; 493/184

[58] Field of Search ..... 229/137, 138, 213, 214; 53/491, 565, 201, 456, 458, 481; 493/165, 184; 206/216, 217; 220/561, 569

[56] References Cited

U.S. PATENT DOCUMENTS

| | | | |
|---|---|---|---|
| 2,047,804 | 7/1936 | Shapiro | 229/138 |
| 3,167,231 | 1/1965 | Bray | 229/214 |
| 3,200,557 | 8/1965 | Schwenk | 493/165 X |
| 3,239,995 | 3/1966 | Monroe et al. | 493/184 X |
| 3,619,979 | 11/1971 | Martensson et al. | 53/565 |
| 3,820,303 | 6/1974 | Martensson et al. | 53/565 |
| 4,730,766 | 3/1988 | Fear | 229/138 X |
| 5,021,040 | 6/1991 | Phillips | 229/137 X |
| 5,083,702 | 1/1992 | Wyberg | 229/137 X |

*Primary Examiner*—Horace M. Culver
*Attorney, Agent, or Firm*—Patrick N. Burkhart

[57] ABSTRACT

A carton blank includes a laminated blank body having a top and a bottom. A plurality of bottom creases are formed in the bottom of the blank body. The bottom creases define bottom flaps that are adapted to be folded and sealed to form a substantially rectangular bottom surface of a finished gable top carton. The bottom flaps are sealed together along a bottom seal that substantially bisects the bottom surface of the finished carton. A plurality of top creases are formed in the top of the blank body. The top creases define top flaps that are adapted to be folded and sealed into a gable top of the finished gable top carton, with the gable top having an upstanding longitudinal top fin. The top creases are arranged on the blank body to enable the carton blank to be folded and sealed such that the top fin of the finished gable top carton may be either parallel with, or transverse to, the bottom seal of the finished gable top carton.

10 Claims, 3 Drawing Sheets

GABLE-TOP CARTON BLANK FOR DIVERSE PACKAGING MACHINES AND METHODS OF MAKING AND USING THE BLANK

TECHNICAL FIELD

The present invention relates to carton blanks that are capable of being formed, filled, and sealed to make gable top containers. Specifically, the present invention relates to carton blanks configured such that they that can be formed, filled, and sealed on incompatible, diverse packaging machines.

BACKGROUND

Gable top cartons have been known for the better part of the twentieth century. Their characteristic simplicity and resealability have helped to sustain their popularity as containers for traditional liquid food products such as milk and juice, but in recent years they have been used for products ranging from ammunition to Epsom salts. Gable top cartons typically start out as generally rectangular carton blanks made of laminated paperboard or similar material. The carton blanks are provided with a number of creases to facilitate folding and forming the blank into a carton.

During decades of development, manufacturers of packaging machines have devised a variety of ways to form, fill, and seal gable top cartons. Today, the most prevalent packaging machines for gable top cartons are adapted to receive the carton blank after it has been side sealed. The process of side sealing involves sealing opposite vertical edges of the carton blank together to form a polygonal (usually rectangular) sleeve The sleeve is received on an indexable mandrel wheel, which rotates the sleeve into respective positions where the end of the sleeve extending outwardly from the mandrel is folded and sealed to form the bottom of the carton.

After the carton bottom has been formed, the carton is then removed from the mandrel and transported to a filling station, where the carton is filled with product. Once the carton has been filled, the top of the carton is folded and sealed into the familiar gable top configuration, thus completing the packaging process. One example of a known packaging machine that operates generally in accordance with these principles is described in U.S. Pat. No. 3,789,746 to Martensson et al.

Although most gable top cartons appear to be substantially identical, materials and processes vary significantly from manufacturer to manufacturer. One of the principal differences is in the alignment between the uppermost edge ("top fin") and the bottom sea of the carton bottom. Some packaging machines, such as the machine of the Martensson patent, produce gable top containers in which the top fin of the finished container is parallel with the bottom seal. Other machines produce containers such as that shown in U.S. Pat. No. 3,770,185 to Reeves, where the top fin of the finished container is transverse to the bottom seal. As a consequence of this difference, carton blanks must be specifically configured and manufactured for each machine, e.g., the Martensson machine cannot receive blanks such as those shown in the Reeves patent, and a machine that can receive the Reeves blank cannot operate with blanks configured for the Martensson machine.

This incompatibility presents serious problems to product packagers, who often have both types of machines in operation. For example, packagers with several different types of machines are required to purchase carton blanks for each type of machine, usually from different producers. The packager is thus prevented from purchasing blanks in large enough quantities to result in a volume discount, and from diverting blanks from one type of machine to another in the event of machine failure or market changes. As can be seen from the foregoing, the need exists for a solution to the problems of incompatible packaging systems.

SUMMARY OF THE INVENTION

The present invention achieves this and other objects by providing a carton blank that is adapted to be received on diverse packaging machines.

In an embodiment, the present invention includes a laminated blank body having a top and a bottom. A plurality of bottom creases are formed in the bottom of the blank body The bottom creases define bottom flaps that are adapted to be folded and sealed to form a substantially rectangular bottom surface of a finished gable top carton. The bottom flaps are sealed together along a bottom seal that substantially bisects the bottom surface of the finished carton. A plurality of top creases are formed in the top of the blank body. The top creases define top flaps that are adapted to be folded and sealed into a gable top of the finished gable top carton, with the gable top having an upstanding longitudinal top fin. The top creases are arranged on the blank body to enable the carton blank to be folded and sealed such that the top fin of the finished gable top carton may be either parallel with, or transverse to, the bottom seal of the finished gable top carton.

The present invention also provides a method of forming gable-top cartons including the following steps. A first carton forming, filling, and sealing apparatus is provided. The first apparatus produces filled gable top cartons having a top fin that is parallel with the bottom seal of the filled and sealed gable top carton. A second carton forming, filling, and sealing apparatus is also provided. The second apparatus produces filled gable top carton having a top fin that is transverse to a bottom seal of the filled and sealed gable top carton. Next, a plurality of identical carton blanks are provided. The first carton forming, filling, and sealing apparatus is used to form, fill, and seal a first carton, having a top fin that is parallel with the bottom seal of the carton, with one of the plurality of identical carton blanks. Finally, the second carton forming, filling, and sealing apparatus is used to form, fill, and seal a second carton, having a top fin that is transverse to the bottom seal of the carton, with another of the plurality of identical carton blanks.

The present invention also provides a method of making a carton blank adapted to be formed into a gable top carton. The method includes the following steps. A laminated carton body is provided, including a top, a bottom, and two sides. Next, at least three substantially equidistantly spaced vertical creases extending from the top of the carton blank to the bottom of the carton blank are formed, thus separating the carton blank into first, second, third, and fourth vertical panels. A horizontal top crease extending substantially between the sides of the carton blank is formed, thus defining first, second, third, and fourth top flaps between the horizontal top crease and the top of the carton blank, with the top flaps separated from one another by upper portions of the vertical creases. A horizontal bottom crease extending substantially between the sides of the carton blank at a position between the bottom of the carton blank and the horizontal top crease is formed, thus defining first, second, third, and fourth bottom flaps between the horizontal bottom crease and the bottom of the carton blank. The bottom flaps are separated from one another by lower portions of the vertical creases. A series of diagonal creases are formed on alternating ones of the bottom flaps such that, during carton formation, the bottom flaps with creases are adapted to fold inwardly while the bottom flaps without creases from a pair of opposed major flaps adapted to be sealed together along a bottom seal. A plurality of creases are formed on the top flaps such that both the first and third top flaps and the second and fourth top flaps are adapted to form gable sides of a finished gable top carton.

Other objects and advantages of the present invention will become apparent upon reference to the accompanying description when taken in conjunction with the following drawings.

DETAILED DESCRIPTION OF THE PREFERRED EMBODIMENT

Figure 1:
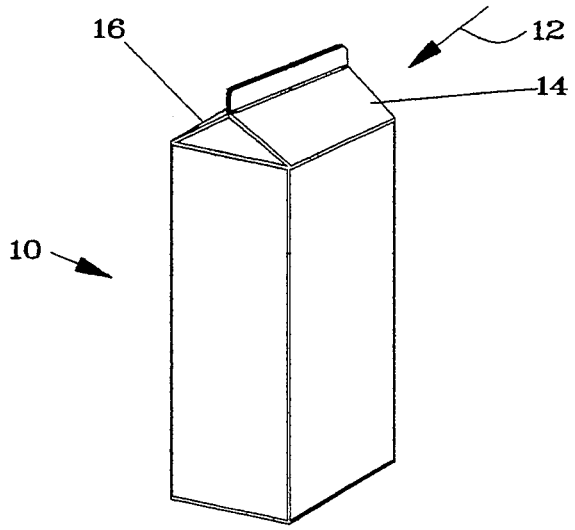
FIG. 1 illustrates a perspective view of a gable top carton.
Figure 2:
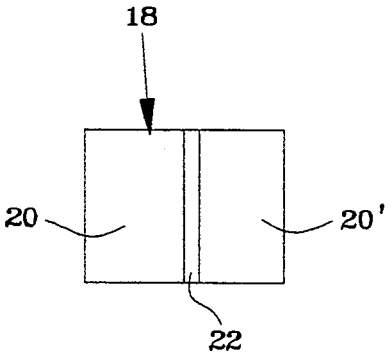
FIG. 2 illustrates a bottom elevational view of a gable top carton.

FIG. 1 illustrates a gable top carton 10 including a gable top 12 having a pair of converging gable sides 14, 16. The gable top carton 10 has a bottom surface 18, as shown in FIG. 2. The bottom surface 18 includes a pair of major flaps 20, 20' sealed along a bottom seal 22 that substantially bisects the bottom surface 18.

Figure 3:
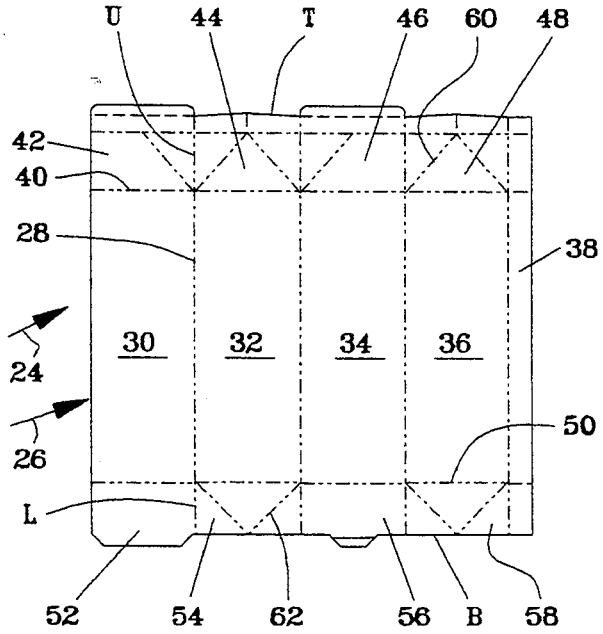
FIG. 3 illustrates an elevational view of a carton blank for forming a carton with a top fin that is parallel with the bottom seal of the carton.

A gable top carton such as that shown in FIG. 1 can be formed using a carton blank 24 of FIG. 3. The blank 24 includes a carton body 26 divided by a plurality of vertical creases 28. The vertical creases 28 extend from the top T to the bottom B of the carton blank, and separate the carton blank 24 into first (30), second (32), third (34), fourth (36), and fifth (38) vertical panels.

A horizontal top crease 40 extends substantially between the sides of the carton blank 24. The top crease 40 intersects with the vertical creases 28 define first (42), second (44), third (46), and fourth (48) top flaps between the horizontal top crease 40 and the top of the carton blank 24, with the top flaps separated from one another by upper portions U of the vertical creases 28. A horizontal bottom crease 50 extends substantially between the sides of the carton blank 24 at a position between the bottom B of the carton blank 24. The bottom crease 50 intersects with the vertical creases 28 to define first (52), second (54), third (56), and fourth (58) bottom flaps between the horizontal bottom crease 50 and the bottom B of the carton blank 24. The bottom flaps are separated from one another by lower portions L of the vertical creases 28.

A series of top diagonal creases 60 are formed on the second top flap 44 and the fourth top flap 46 of the carton blank 24. The top diagonal creases 60 enable the second and fourth top flaps to be folded inwardly toward one another during carton formation, thus causing the first top flap 42 and third top flap 48 to become the gabled sides of the finished carton.

A series of bottom diagonal creases 62 are formed on the second bottom flap 54 and the fourth bottom flap 58 of the carton blank 24. The bottom diagonal creases 62 enable the second and fourth bottom flaps to be folded inwardly toward one another during carton formation, while the first bottom flap 52 and the third bottom flap 56 become the major flaps that form the bottom exterior surface of the finished carton.

Figure 4:
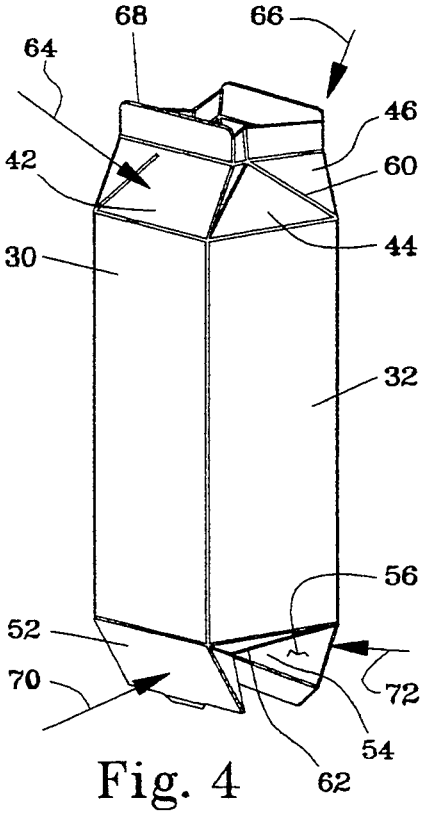
FIG. 4 illustrates a schematic view of the top and bottom sealing process for the carton blank shown in FIG. 3.

The forming process for the carton blank 24 is schematically illustrated in FIG. 4. Force is applied to the top portion of the partially erected carton blank 24 in the direction of arrows 64 and 66 in such a way as to cause the top flap 44, along with the top flap 48 (not visible in FIG. 4) to fold inwardly toward one another, due to the diagonal creases 60. The top flap 42 and the top flap 46 thus form gable sides of the finished carton, sealed together at a top fin 68.

Force is also applied in the direction of arrows 70 and 72 to the bottom portion of the partially erected carton blank 24, thus causing the bottom flap 54, along with the bottom flap 58 (not visible in FIG. 4) to fold inwardly toward one another, due to the diagonal creases 62. The bottom flap 52 and the bottom flap 56 thus form major flaps of the finished carton, sealed together at a bottom seal 74.

As can be seen in FIG. 4, the configuration of the creases on the carton blank 24 is such that the top fin 68 is parallel to the bottom seal 74. The blank configuration shown in FIGS. 3 and 4 can only be formed and filled in machines specially adapted to receive this type of carton blank, such as that described in U.S. Pat. No. 3,789,746 to Martensson et al.

Figure 5:
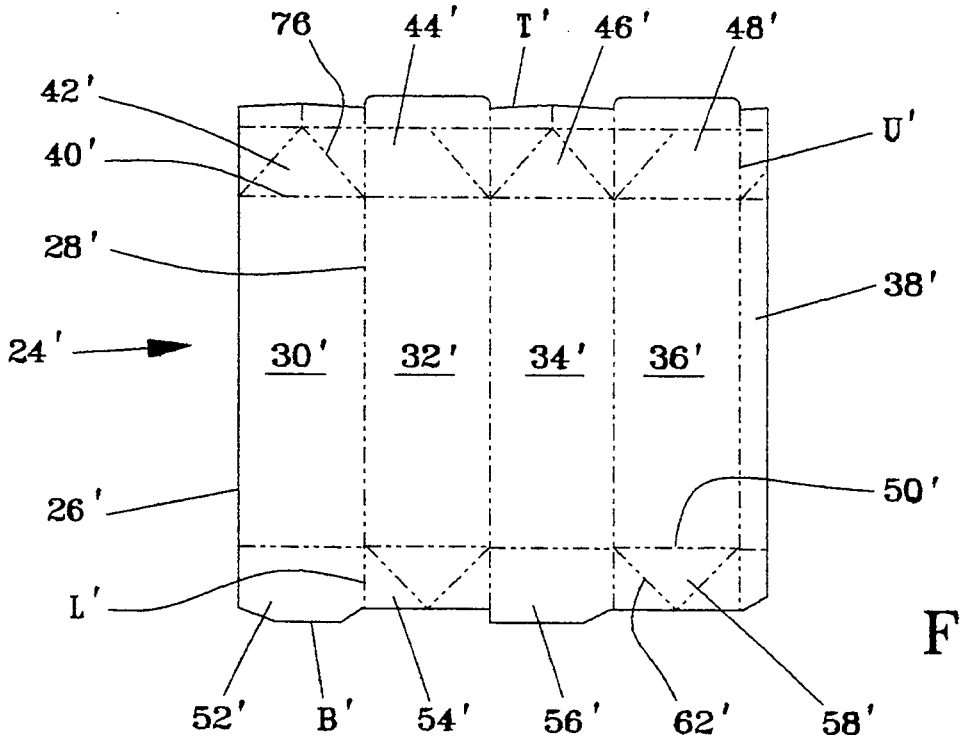
FIG. 5 illustrates an elevational view of a carton blank for forming a carton with a top fin that is transverse to the bottom seal of the carton.

A gable top carton can be formed using a carton blank 24' of FIG. 5. The blank 24' includes a carton body 26' divided by a plurality of vertical creases 28'. The vertical crease 28' extend from the top T' to the bottom B' of the carton blank, and separate the carton blank 24' into first (30'), second (32'), third (34'), fourth (36'), and fifth (38') vertical panels.

A horizontal top crease 40' extends substantially between the sides of the carton blank 24'. The top crease 40' intersects with the vertical creases 28' define first (42'), second (44'), third (46'), and fourth (48') top flaps between the horizontal top crease 40' and the top T' of the carton blank 24', with the top flaps separated from one another by upper portions U' of the vertical creases 28'. A horizontal bottom crease 50' extends substantially between the sides of the carton blank 24' at a position between the bottom B' of the carton blank 24'. The bottom crease 50' intersects with the vertical creases 28' to define first (52'), second (54'), third (56'), and fourth (58') bottom flaps between the horizontal bottom crease 50' and the bottom B' of the carton blank 24' . The bottom flaps are separated from one another by lower portions L' of the vertical creases 28'.

A series of top diagonal creases 76 are formed on the first top flap 42' and the third top flap 46' of the carton blank 24'. The top diagonal creases 76 enable the first and third top flaps to be folded inwardly toward one another during carton formation, thus causing the second top flap 44' and the fourth top flap 48' to become the gabled sides of the finished carton.

A series of bottom diagonal creases 62' are formed on the second bottom flap 54' and the fourth bottom flap 58' of the carton blank 24'. The bottom diagonal creases 62' enable the second and fourth bottom flaps to be folded inwardly toward one another during carton formation, while the first bottom flap 52' and the third bottom flap 56' become the major flaps that form the bottom exterior surface of the finished carton.

Figure 6:
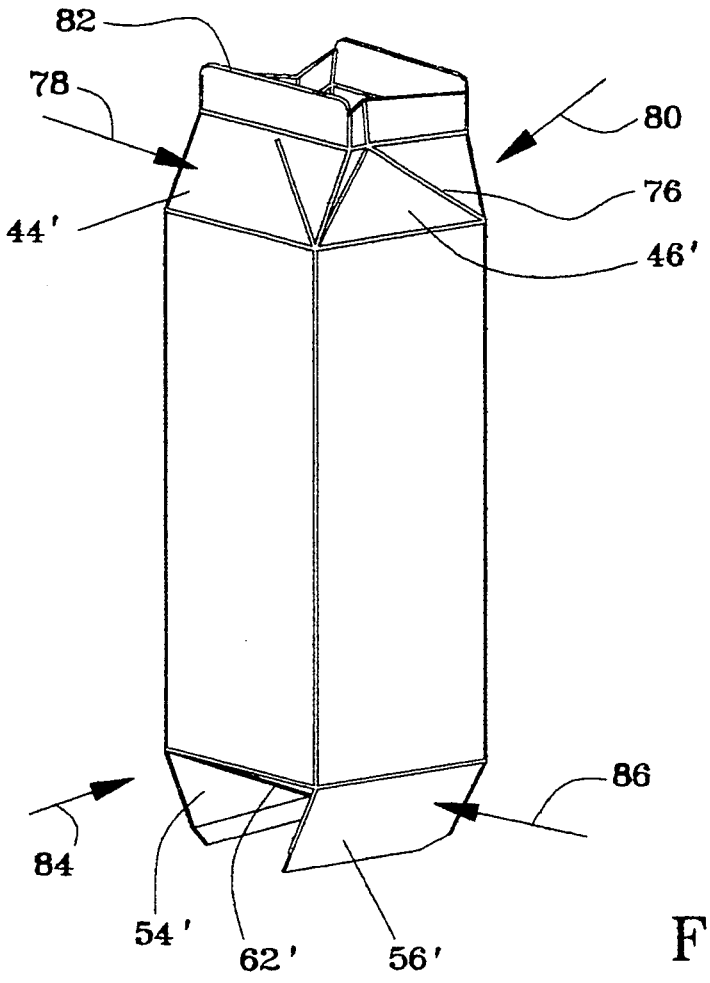
FIG. 6 illustrates a schematic view of the top and bottom sealing process for the carton blank shown in FIG. 5.

The forming process for the carton blank 24' is schematically illustrated in FIG. 6. Force is applied to the top portion of the partially erected carton blank 24' in the direction of arrows 78 and 80 in such a way as to cause the top flap 42', along with the top flap 46'(no visible in FIG. 6) to fold inwardly toward one another, due to the diagonal creases 76. The top flap 44' and the top flap 48' thus form gable sides of the finished carton, sealed together at a top fin 82.

Force is also applied in the direction of arrows 84 and 86 to the bottom portion of the partially erected carton blank 24', thus causing the bottom flap 54', along with the bottom flap 58' (not visible in FIG. 6) to fold inwardly toward one another, due to the diagonal creases 62'. The bottom flap 52' and the bottom flap 56' thus form major flaps of the finished carton, sealed together at a bottom seal 88.

As can be seen in FIG. 6, the configuration of the creases on the carton blank 24' is such that the top fin 82 is transverse to the bottom seal 88. The blank configuration shown in FIGS. 5 and 6 can only be formed and filled in machines specially adapted to receive this type of carton blank, such as machines used to produce containers as shown in U.S. Pat. No. 3,770,185 to Reeves.

Figure 7:
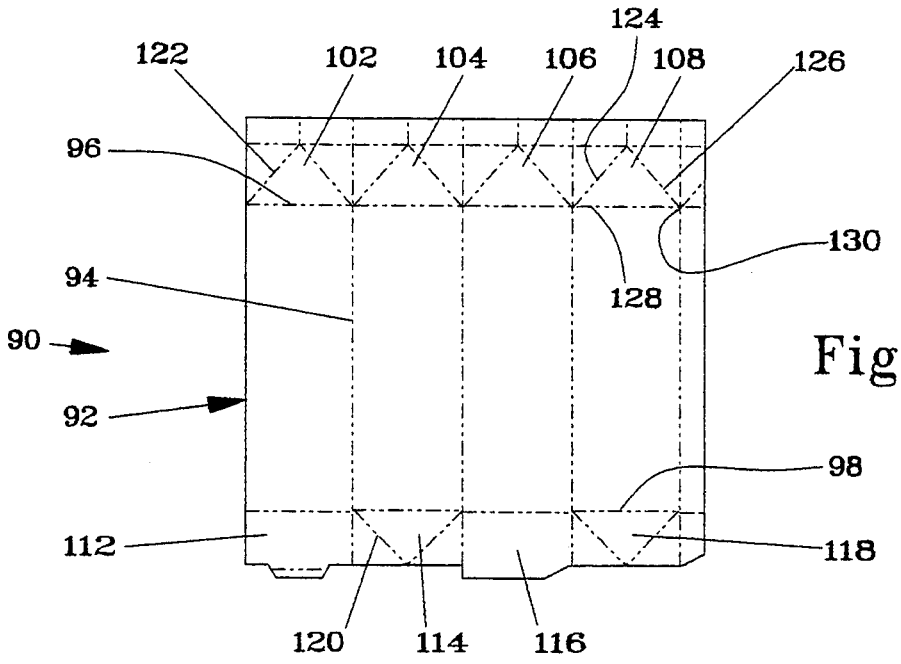
FIG. 7 illustrates an elevational view of a carton blank for forming a carton with a top fin that is either parallel with or transverse to the bottom seal of the carton.

FIG. 7 illustrates a carton blank 90 configured in accordance with the principals of the present invention. The blank 90 includes a carton body 92 with vertical and horizontal creases similar to those shown in carton blanks 24 and 24' in FIGS. 3 and 5. The carton blank body 92 is divided by a plurality of vertical creases 94. The vertical creases 94 intersect a top horizontal crease 96 and a bottom horizontal crease 98. The carton blank 9 includes first (102), second (104), third (106), and fourth (108) top flaps above the horizontal top crease 96, and first (112), second (114), third (116), and fourth (118) bottom flaps below the bottom horizontal crease 98.

A series of bottom diagonal creases 120 are formed on the second bottom flap 114 and the fourth bottom flap 118 of the carton blank 90. The bottom diagonal creases 120 enable the second and fourth bottom flaps to be folded inwardly toward one another during carton formation, while the first bottom flap 112 and the third bottom flap 116 become the major flaps that form the bottom exterior surface of the finished carton.

A series of top diagonal creases 122 are formed on each of the top flaps 102–108. The top diagonal creases 122 are, in this embodiment, pairs of diagonal creases 124, 126 converging from laterally opposite corners 128, 130 of the respective top flaps. The top diagonal creases 122 enable any alternative pair of top flaps to be folded inwardly toward one another during carton formation, thus causing the other alternative pair of top flaps to become the gabled sides of the finished carton.

Figure 8:
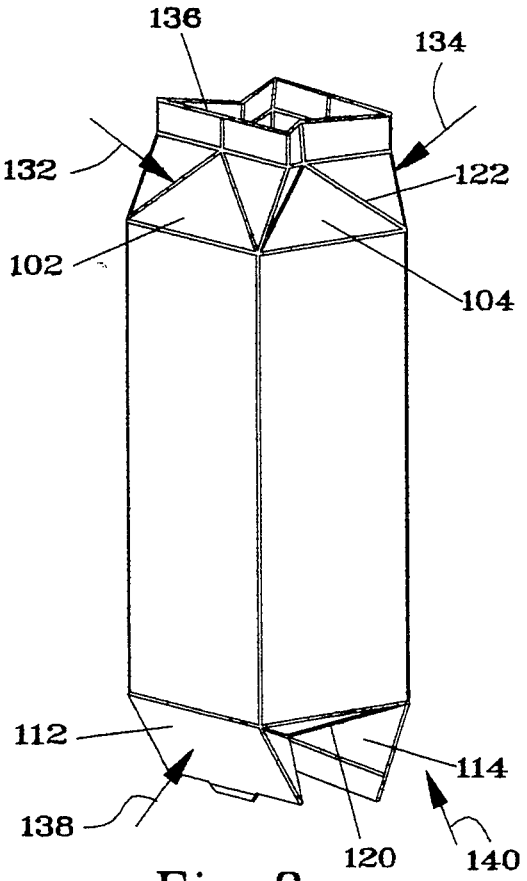
FIGS. 8 and 9 illustrate alternative top and bottom sealing processes for the carton blank shown in FIG. 7.

For example, if the carton blank 90 is fed into a filling machine such as that shown in the Martensson patent, carton formation would occur as shown in FIG. 8. Force would be applied to the top portion of the partially erected carton blank in the direction of arrows 132 and 134 in such a way as to cause the top flap 104, along with the top flap 108 (not visible in FIG. 8), to fold inwardly toward one another, due to the diagonal creases 122. The top flap 102 and the top flap 106 would thus form gable sides of the finished carton, sealed together at a top fin 136.

Force would also be applied in the direction of arrows 138 and 140 to the bottom portion of the partially erected carton blank, thus causing the bottom flap 114, along with the bottom flap 118 (not visible in FIG. 8), to fold inwardly toward one another, due to the diagonal creases 120. The bottom flap 112 and the bottom flap 116 would thus form major flaps of the finished carton, sealed together at a bottom seal. The finished carton would have a top fin that would be parallel with the bottom seal.

Figure 9:
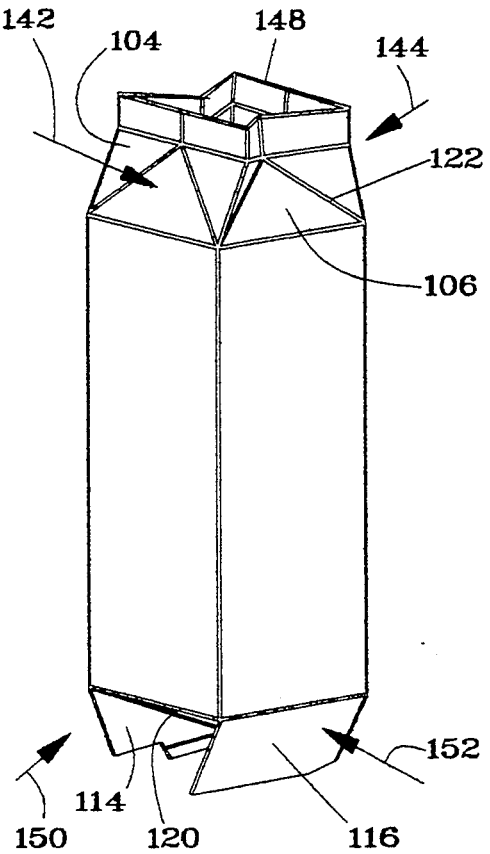

As shown in FIG. 9, it is also possible for the carton blank 90 to be used to produce containers such as that shown in the Reeves patent. In this instance, force would applied to the top portion of the partially erected carton blank in the direction of arrows 142 and 144, in such a way as to cause the top flap 106, along with the top flap 102 (not visible in FIG. 9), to fold inwardly toward one another, due to the diagonal creases 122. The top flap 104 and the top flap 108 would thus form gable sides of the finished carton, sealed together at a top fin 148.

Force would also be applied in the direction of arrows 150 and 152 to the bottom portion of the partially erected carton blank, thus causing the bottom flap 114, along with the bottom flap 118 (not visible in FIG. 9), to fold inwardly toward one another, due to the diagonal creases 120. The bottom flap 112 and the bottom flap 116 would thus form major flaps of the finished carton, sealed together at a bottom seal. Here, the top fin 148 of the finished carton would be transverse to the bottom seal.

Unlike the blanks of FIGS. 3 and 5, the blank configuration shown in FIG. 7 can be formed and filled equally well in machines used to produce containers as shown in U.S. Pat. No. 3,770,185 to Reeves and in machines such as that described in U.S. Pat. No. 3,789,746 to Martensson et al. This ability permits packagers with different types of machines to purchase a single carton blank configuration that will function in each machine type. The packager can thus purchase blanks in large enough quantities to take advantage of volume discounts, and to divert blanks from one type of machine to another according to machine availability and market needs.

Although the present invention has been described with reference to a specific embodiment, those of skill in the art will recognize that changes may be made thereto without departing from the scope and spirit of the invention as set forth in the appended claims.

I claim as my invention:

1. A carton blank for forming a gable top carton comprising the following:

a laminated blank body having a top and a bottom;

a plurality of bottom creases formed in the bottom of the blank body to define bottom flaps that are adapted to be folded and sealed to form a substantially rectangular bottom surface of a finished gable top carton having a bottom seal substantially bisecting the bottom surface of the finished carton; and a plurality of top creases formed in the top of the blank body, the top creases defining top flaps that are adapted to be folded and sealed into a gable top of the finished gable top carton, with the gable top having an upstanding longitudinal top fin; whereby the top creases are arranged on the blank body to enable the carton blank to be folded and sealed such that the top fin of the finished gable top carton may be alternatively parallel with or transverse to the bottom seal of the finished gable top carton.

2. A carton blank according to claim 1, further comprising a plurality of substantially equidistantly spaced vertical creases extending from the top of the carton blank to the bottom of the carton blank, separating the carton blank into first, second, third and fourth vertical panels.

3. A carton blank according to claim 2, wherein the plurality of top creases includes a horizontal top crease extending substantially between the sides of the carton blank, defining first, second, third, and fourth top flaps between the horizontal top crease and the top of the carton blank, with the top flaps being separated from one another by upper portions of the vertical creases.

4. A carton blank according to claim 2, wherein the plurality of bottom creases includes a horizontal bottom crease extending substantially between the sides of the carton blank, defining first, second, third, and fourth bottom flaps between the horizontal bottom crease and the bottom of the carton blank, with the bottom flaps being separated from one another by lower portions of the vertical creases.

5. A carton blank according to claim 2, wherein the plurality of top creases includes an identical plurality of diagonal creases formed on each top flap of the carton blank.

6. A carton blank according to claim 5, wherein each plurality of diagonal creases comprises a pair of diagonal creases converging from laterally opposite corners of the respective top flaps.

7. A carton blank according to claim 3, wherein the plurality of bottom creases includes an identical plurality of diagonal creases formed on a non-adjacent pair of bottom flaps of the carton blank.

8. A method of forming gable-top cartons comprising the following steps:

providing a first carton forming, filling, and sealing apparatus that produces filled gable top cartons having a top fin that is parallel with a bottom seal of the filled and sealed gable top carton;

providing a second carton forming, filling, and sealing apparatus that produces filled gable top cartons having a top fin that is transverse to a bottom seal of the filled and sealed gable top carton;

providing a plurality of identical carton blanks;

using the first carton forming, filling, and sealing apparatus to form, fill, and seal a first carton, having a top fin that is parallel with the bottom seal of the carton, with one of the plurality of identical carton blanks; and using the second carton forming, filling, and sealing apparatus to form, fill, and seal a second carton, having a top fin that is transverse to the bottom seal of the carton, with another one of the plurality of identical carton blanks.

9. A method of making a carton blank adapted to formed into a gable top carton comprising the following steps:

providing a laminated carton body including a top, a bottom, and two sides;

forming at least three substantially equidistantly spaced vertical creases extending from the top of the carton blank to the bottom of the carton blank, thus separating the carton blank into first, second, third, and fourth vertical panels;

forming a horizontal top crease extending substantially between the sides of the carton blank, thus defining first, second, third, and fourth top flaps between the horizontal top crease and the top of the carton blank, with the top flaps being separated from one another by upper portions of the vertical creases;

forming a horizontal bottom crease extending substantially between the sides of the carton blank at a position between the bottom of the carton blank and the horizontal top crease, thus defining first, second, third, and fourth bottom flaps between the horizontal bottom crease and the bottom of the carton blank, with the bottom flaps being separated from one another by lower portions of the vertical creases;

forming a series of diagonal creases on alternating ones of the bottom flaps such that, during carton formation, the bottom flaps with creases are adapted to fold inwardly while the bottom flaps without creases form a pair of opposed major flaps adapted to be sealed together along a bottom seal; and forming a plurality of creases on the top flaps such that both the first and third top flaps and the second and fourth top flaps are adapted to form gable sides of a finished gable top carton.

10. A method of forming a gable top carton comprising the following steps:

providing a carton blank body;

forming a plurality of vertical and horizontal creases on the carton blank body to define at least four top flaps and at least four bottom flaps;

forming diagonal creases on all four of the top flaps of the carton blank body such that every alternate pair of top flaps is adapted to form gable sides of a finished gable top carton;

forming diagonal creases on a first alternate pair of bottom flaps such that a second alternate pair of bottom flaps is adapted to form major flaps of a finished gable top carton;

feeding the carton blank into a carton forming, filling, and sealing apparatus; and actuating the apparatus to form, fill, and seal a gable top carton using the carton blank.

* * * * *

UNITED STATES PATENT AND TRADEMARK OFFICE

CERTIFICATE OF CORRECTION

PATENT NO. : 5,337,538

DATED : August 16, 1994

INVENTOR(S) : Tommy B. G. Ljungstrom

It is certified that error appears in the above-indentified patent and that said Letters Patent is hereby corrected as shown below:

Column 1, line 33, "sleeve" should read --sleeve.--
Column 1, line 52, "sea" should read --seal--
Column 3, line 10, "from" should read --form--

Signed and Sealed this

Twenty-seventh Day of December, 1994

*Attest:*

Bruce Lehman

BRUCE LEHMAN

*Attesting Officer*

*Commissioner of Patents and Trademarks*